US007183545B2

(12) United States Patent
Wang

(10) Patent No.: US 7,183,545 B2
(45) Date of Patent: Feb. 27, 2007

(54) MULTIPOLE ION MASS FILTER HAVING ROTATING ELECTRIC FIELD

(75) Inventor: Mingda Wang, Fremont, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 11/081,048

(22) Filed: Mar. 15, 2005

(65) Prior Publication Data

US 2006/0219933 A1 Oct. 5, 2006

(51) Int. Cl.
*H01J 49/42* (2006.01)

(52) U.S. Cl. ..... 250/292; 250/281; 250/282

(58) Field of Classification Search ..... 250/292, 250/291, 281, 282
See application file for complete search history.

(56) References Cited

U.S. PATENT DOCUMENTS

| | | | |
|---|---|---|---|
| 2,939,952 | A | 6/1960 | Paul et al. |
| 2,950,389 | A | 8/1960 | Paul et al. |
| 3,065,640 | A | 11/1962 | Langmuir et al. |
| 4,090,075 | A | 5/1978 | Brinkmann |
| 4,136,280 | A | 1/1979 | Hunt et al. |
| 4,189,640 | A | 2/1980 | Dawson |
| 4,214,460 | A | 7/1980 | Shima |
| 4,540,884 | A | 9/1985 | Stafford et al. |
| 4,569,741 | A | 2/1986 | Pohl |
| 4,602,226 | A | 7/1986 | Vatis |
| 4,721,854 | A | 1/1988 | Dawson |
| 4,736,101 | A | 4/1988 | Syka et al. |
| 4,755,670 | A | 7/1988 | Syka et al. |
| 5,089,703 | A | 2/1992 | Schoen et al. |
| 5,227,629 | A | 7/1993 | Miseki |
| 5,291,017 | A | 3/1994 | Wang et al. |
| 5,381,007 | A | 1/1995 | Kelley |
| 5,420,425 | A | 5/1995 | Bier et al. |
| 5,463,219 | A | 10/1995 | Buckley et al. |
| 5,464,975 | A | 11/1995 | Kirchner et al. |
| 5,572,022 | A | 11/1996 | Schwartz et al. |
| 5,714,755 | A | 2/1998 | Wells et al. |
| 5,726,448 | A | 3/1998 | Smith et al. |

(Continued)

FOREIGN PATENT DOCUMENTS

| | | |
|---|---|---|
| GB | 1539607 | 1/1979 |

(Continued)

OTHER PUBLICATIONS

Ion rotating motion in a gas-filled radio-frequency quadrupole ion guide as a new technique for structural and kinetic investigations of ions, Rapid Communications in Mass Spectrometry, Rapid Commun. Mass Spectrum. 2001; 15; 1912-1921; Copyright 2001 John Wiley & Sons, Ltd.

(Continued)

*Primary Examiner*—Kiet T. Nguyen

(57) ABSTRACT

A method of operating an ion filter for selecting ions and related apparatus. The filter have a plurality of elongated electrodes, and the ions have a secular frequency. The method comprises exciting each elongated electrode with a first voltage component, the first voltage component having a first amplitude and a first frequency; exciting each elongated electrode with a second voltage component, the second voltage component having a frequency substantially equal to a secular frequency of motion for the ion; and generating an electric field and rotating the electric field around the axis.

25 Claims, 5 Drawing Sheets

U.S. PATENT DOCUMENTS

| | | | | |
|---|---|---|---|---|
| 5,734,162 | A | 3/1998 | Dowell | |
| 5,818,055 | A | 10/1998 | Franzen | |
| 6,075,244 | A * | 6/2000 | Baba et al. | 250/292 |
| 6,114,691 | A | 9/2000 | Cousins | |
| 6,153,880 | A | 11/2000 | Russ, IV et al. | |
| 6,177,668 | B1 | 1/2001 | Hager | |
| 6,403,955 | B1 | 6/2002 | Senko | |
| 6,573,496 | B2 | 6/2003 | Harada | |
| 6,593,570 | B2 | 7/2003 | Li et al. | |
| 6,610,979 | B2 | 8/2003 | Harada | |
| 6,649,911 | B2 | 11/2003 | Kawato | |
| 6,693,276 | B2 | 2/2004 | Weiss et al. | |
| 6,838,666 | B2 | 1/2005 | Ouyang et al. | |
| 2001/0035498 | A1 | 11/2001 | Li et al. | |
| 2002/0070338 | A1 | 6/2002 | Loboda | |
| 2003/0141445 | A1 | 7/2003 | Glukhoy | |
| 2003/0201387 | A1 | 10/2003 | Hartley et al. | |

FOREIGN PATENT DOCUMENTS

| | | |
|---|---|---|
| WO | WO 98/22972 | 5/1998 |
| WO | WO 98/52209 | 11/1998 |
| WO | WO 98/56030 | 12/1998 |

OTHER PUBLICATIONS

Inductive Flux Build-Up of RMF Formed FRCs, Alan Hoffman and Richard D. Milroy, Redmond Plasma Physics Laboratory, University of Washington, APS/DPP Nov. 15-19, 2004 Savannah, Georgia.

Structure and control of Coulomb crystals in a Penning trap*, X.-P. Huang, J.J. Bollinger, W.M. Itano, J.N. Tan, B. Jelenkovic*, T.B. Mitchell and D.J. Wineland, National Institute of Standards and Technology, MS 847, Boulder, CO 80303, USA; J.C. Baltzer AG, Science Publishers; Hyperfine Interactions 115 (1998) 41-45.

Linear Ion Traps in Mass Spectrometry, Donald J. Douglas, Aaron J. Frank, and Dunmin Mao Department of Chemistry, University of British Columbia, 2036 Main Mall, Vancouver, B.C., V6T 1Z1, Canada; Mass Spectrometry Reviews. 2005, 24. 1-29, 2004 by Wiley Periodicals, Inc.

Resonance Excitation of Ions Stored in a Quadrupole Ion Trap. Part 1. A Simulation Study, International Journal of Mass Spectrometry and Ion Processes, 95 (1989) 119-156, Elsevier Science Publishers B.V., Amsterdam-Printed in the Netherlands.

Resonance Excitation of Ions Stored in a Quadrupole Ion Trap Part II. Further Simulation Studies, International Journal of Mass Spectrometry and Ion Processes, 99 (1990) 109-124, Elsevier Science Publishers B.V., Amsterdam.

Stabilization of Interchange Modes by Rotating Magnetic Fields (RMF), Houyang Guo, Alan Hoffman, Richard Milroy, Ken Miller, George Votroubek, Redmond Plasma Physics Laboratory University of Washington, US-Japan Santa-Fe, Santa-Fe, NM, Sep. 14-16, 2004.

Introduction to Mass Spectrometry, The University of Arizona, Department of Chemistry, http://www.chem.arizona.edu/massspec/intro_html/intro.html, pp. 1-5.

TOF Fundamentals, TOF Tutorial by R.M. Jordan Co., Inc. All rights reserved. pp. 1-18.

Introduction to Mass Spectrometry, Dr. Allison E. Ashcroft; Mass Spectrometry Facility Manager, Astbury Centre for Structural Molecular Biology, School of Biochemistry & Molecular Biology, The University of Leeds, http://www.astbury.leeds.ac.uk/Facil/MStut/mstutorual.htm, pp. 1-23.

What is Mass Spectrometry?, http://www.brnss.org.uk/what_is/whatis.html, pp. 1-7.

American Society for Mass Spectrometry::Education, What is Mass Spectrometry?, http://wwww.asms.org/whatisms/p13.html, pp. 1-3.

Zhen Zhou, Thesis, University of Giessen (2000).

Abandoned copy of patent application identified as U.S. Appl. No. 09/440,373.

Office action having a mailing date of Feb. 14, 2001 for U.S. Appl. No. 09/440,373.

Mingda Wang and Alan G. Marshall, Laboratory-Frame and Rotating-Frame Ion Trajectories in Ion Cyclotron Resonance Mass Spectrometry; International Journal of Mass Spectrometry and Ion Processes, 100; 323-346, 1990.

* cited by examiner

MULTIPOLE ION MASS FILTER HAVING ROTATING ELECTRIC FIELD

BACKGROUND

Ion mass filters and ion traps are used in mass spectrometers for atomic and chemical analysis to determine the quantity and atomic or chemical makeup of unquantified or unknown compounds. A quadrupole mass spectrometer system generally includes a source of ions, a quadrupole mass filter, an ion detector and associated electronics. A gaseous, liquid, or solid sample is ionized in the ion source and a portion of the ions created in the ion source is injected into the quadrupole mass filter. The filter rejects all ions except those with masses in a mass-to-charge ratio (mass/charge) window as determined by the system electronics. (It will be understood from the context herein where the references to mass without mentioning charge refer to the mass-to-charge ratio, as appropriate, even though charge is not specifically expressed, because the effects of fields on ions depend on the charge of the ions).

The mass window (or resolution) is usually adjusted to be about 1 atomic mass unit (AMU) or less, centered at a particular, selected mass. Because the masses of the elements making up the sample are often unknown, the system varies (scans) the range of selected masses from a starting mass number to an ending mass number to test for and to sense ions having masses within the selected mass range. The scanned mass range can be as low as one AMU and as high as thousands of AMU. The system operates either automatically or under manual control. The mass analysis of the composition of the sample is performed by rapidly scanning the DC and RF voltages, or the frequency of the RF voltage, applied to the quadrupole filter, thereby scanning through the possible ion masses and recording the abundance of each as transmitted through the mass filter.

Referring to FIG. 1, a conventional quadrupole mass spectrometer 30 includes a source of ions 32 driven by a suitable power supply 34 for ejecting ions from the opening 36 in the source 32. The source 32 of ions can be any one or more of a number of devices, including electron impact, atmospheric pressure chemical ionization, inductively coupled plasma, electrospray or the collision cell of a tandem mass spectrometer, e.g., a triple quadrupole.

While the ions may leave source 32 with a range of directions and velocities, they are traveling generally in the direction of the central axis 38 of the quadrupole mass filter 40. The central axis 38 is generally considered the Z-direction represented at 42. Ions may also have components of velocity in the directions of the X-axis and the Y-axis, respectively identified with reference numbers 44 and 46.

The quadrupole mass spectrometer 30 also may include ion optics 88 to generally focus the ions toward the quadrupole mass filter 40 and along the central axis 38. Elements of ion optics 88, which may be, for example, aperture lenses or ion guides, may have DC or RF voltages applied to them by one or more voltage supplies 56. Voltage supply 56 may be controlled and operated by a controller 58 or other apparatus. As an example of ion optics 88, a typical mass spectrometer with an atmospheric pressure ion source may have a skimmer and one or more RF ion guides before the quadrupole mass filter.

A conventional quadrupole mass filter 40 includes four conductive rods arranged with their long axes parallel to a central axis and equidistant from it. For most purposes, the cross sections of the rods are preferably hyperbolic, although rods of circular cross section ("round rods") are common.

Other rod shapes have been used, such as those having flat or concave faces. To select which ions are rejected and which are transmitted through the quadrupole mass filter 40, an adjustable voltage ±(U+V cos Ωt) is applied on adjacent rods, so that opposite rods have equal potentials and adjacent rods have equal potentials but opposite polarities. U is the DC voltage and V is the amplitude of the radio frequency (RF) voltage applied to the rods, Ω being its (angular) frequency. The electric field created within the region surrounded by the rods is a quadrupole field, resulting in a force on an ion in that region directly proportional to the distance of the ion from the central axis 38.

The mass filter 40 is driven by a suitable quadrupole voltage supply 64, which may be controlled by a suitable controller 58 such as a microprocessor programmed with control software and data sufficient to allow the quadrupole mass filter to scan over a desired ion mass range. As is known, the conventional quadrupole mass filter 40 filters out ions outside a narrow mass window and transmits ions within the window to an ion detector, which is formed by an ion collector 66 and an analyzer 68 that analyzes the collected ions. The analyzer 68 may be controlled by, may output results to, and may be a part of the controller 58.

Voltages applied to the quadrupole rods create an electric field between the poles that may change the radial energy of the ions entering the quadrupole filter 40. In quadrupole fields, ions have generally predictable characteristics. Ion motion in a quadrupole field has the form:

$$\frac{d^2u}{d\zeta^2} + (a_u - 2q_u\cos 2\zeta)u = 0 \qquad [1]$$

where u represents either the x or y direction, $\zeta=\Omega t/2$ and Ω is the frequency of the RF voltage applied to the quadrupole rods. Variables $a_u$ and $q_u$ are defined as:

$$a_u = a_x = -a_y = \frac{4eU}{m\Omega^2 r_0^2} \text{ and} \qquad [2]$$

$$q_u = q_x = -q_y = \frac{2eV}{m\Omega^2 r_0^2} \qquad [3]$$

In equations [2] and [3], U and V are the magnitudes of DC and RF voltages, respectively. The ion trajectories can be expressed as:

$$u(\zeta) = A\sum_{-\infty}^{+\infty} c_{2n}\cos(2n+\beta)\zeta + B\sum_{-\infty}^{+\infty} c_{2n}\cos(2n+\beta)\zeta \qquad [4]$$

where β is a function of $a_u$ and $q_u$, and thus, U and V. The trajectories exhibit oscillations in the x- and y-directions. For certain values of $a_u$ and $q_u$, the trajectories are periodic and will allow ions to pass through the mass filter without striking a rod; the ion trajectory or path is said to be stable. Whether a trajectory is stable in the field depends on where the ion mass is mapped into the stability diagram of FIG. 9. If the ion mass is such that the a, q values fall below the $\beta_y=0$ and $\beta_x=1.0$ lines, the trajectory will be stable. The stability thus depends upon the values of U and V for a given mass. (Stability also depends upon the initial position and velocity of the ion at the entrance to the quadrupole mass filter, as is known in the art.) If the U/V ratio and the value of V are such that the operation is near the very apex ($\beta_y$=0, $\beta_x$=1.0) of the stability diagram, only a very narrow range of ion masses will have stable trajectories. This is the principle of the quadrupole mass filter and it allows operation as a mass spectrometer by scanning the RF voltage while keeping the DC/RF voltage ratio constant.

Equation [4] indicates that ion motion in a quadrupole electric field consists of a set of secular frequencies given by $$\omega_n = (2n+\beta)\frac{\Omega}{2}, \quad n = 0, \pm 1, \pm 2, \ldots \qquad [5]$$

If an auxiliary AC voltage is applied to the rods, creating an auxiliary AC electric field within the rods, and is tuned to one of the secular frequencies $\omega_n$, the ion will absorb energy and oscillate with increased amplitude. The ion also absorbs energy, with increase of trajectory amplitude, if the auxiliary AC voltage is at the parametric resonance frequency, $\beta\Omega$ (twice the lowest secular frequency).

The effectiveness of a mass spectrometer system is determined in large part by its sensitivity and selectivity, the latter usually being called resolution. Sensitivity determines how small a quantity of sample can be detected and its constituents quantified. Resolution must be sufficient for two adjacent mass peaks to be clearly separated such that their separate characteristics can be determined.

One can increase the resolution of a quadrupole mass filter by decreasing the RF/DC voltage ratio, but increasing the resolution decreases the number of ions transmitted through the mass filter 40. Even for a selected ion mass, the transmission of ions through the mass filter 40 and output from the mass filter 40 is a fraction of the ions input to the mass filter 40. With lower transmission, the amount of ions in the sample becomes more important and it may be more difficult to qualify the results for each mass peak in a spectrum as signal to noise ratios decrease. The resolution achievable depends on accuracy of the quadrupole electric field, the mass of the ion and the length of the mass filter 40, and the transmission depends on the resolution and the input conditions of the ions, i.e., on the positions and velocities of the ions as they enter the mass filter 40. Other factors affect the operation of the mass filter 40, such as fringe fields at the ends of the mass filter 40, the presence or absence of focusing elements, and the voltages that may be applied to these focusing elements. While many of these factors are understood, there is room for improvement in the resolution and sensitivity of mass filter spectrometers.

Quadrupole mass filters for use in mass spectrometers as described above have several shortcomings. For example, electrodes for quadrupole mass filter spectrometers having a unit mass resolution and reasonable ion transmission rate are fabricated with precisions on the order of tenths of microns to microns. The cost of such precision quadrupole mass spectrometers is high.

A quadrupole mass filter can be operated in an RF-only mode without a DC voltage between adjacent rods. In this design, ion radial motion is excited by bringing the ions to the boundary of the ion stability diagram. Mass separation is achieved by coupling the ion radial (x, y) motion and the axial (z-direction) motion in the exit region. A spectrum of masses is obtained by varying or scanning the RF voltage to sequentially bring the q of various masses close to a value of about 0.907, in other words near the stability boundary of the ion stability diagram on the q-axis. At that point, ions having the mass of interest acquire large radial energies that are converted by the fringing fields to increased axial energy relative to ions of other masses when exiting the quadrupole field. The increased axial energy allows those ions to pass through an impeding energy barrier or exit energy filter while the impending energy barrier blocks other masses having lower axial energies.

An RF-only mass filter need not require as much precision in the fabrication and assembly of the quadrupole electrodes in order to achieve reasonable resolutions and extended mass range, since the unwanted ion discrimination is assisted by the energy filtering. However, the resolution may still not be as good as that exhibited by the high-precision mass filters. Incorporation of a stopping element on the axis at the exit of the quad results in some improvement in performance but with sacrifice of desired ion transmission. There is thus a need for an improved, low-cost mass filter design.

SUMMARY

In general terms, the present invention relates to a multipole ion mass filter that includes a rotating electric field. An ion mass filter embodying the present invention can be used in a variety of instrumentation including a mass spectrometer.

One aspect of the claimed invention is an apparatus for filtering non-selected ions and passing selected ions according to a mass-to-charge ratio. The selected ions have a secular frequency. The apparatus comprises a plurality of elongated electrodes positioned substantially parallel to an axis. A power supply is in electrical communication with the plurality of elongated electrodes. The power supply generates two voltage components, the first voltage component having a first amplitude and a first frequency, the second voltage component having a second amplitude and a second frequency. The second frequency is substantially equal to a secular frequency of motion for the selected ion. The second frequency component provided to each elongated electrode has a different phase.

Another aspect of the invention comprises four elongated electrodes, the elongated electrodes positioned substantially parallel to and equidistant from an axis. A circular disk is positioned downstream from the elongated electrodes, the circular disk being substantially orthogonal to and centered on the axis. A power supply is in electrical communication with the four elongated electrodes. The power supply generating two voltage components without a D.C. offset, the first voltage component having a first amplitude and a first frequency, the second voltage component having a second amplitude and a second frequency. The second frequency is substantially equal to a secular frequency of motion for the ion. The second frequency component provided to the first electrode has a first phase, the second frequency provided to the second electrode is shifted about 90° from the first phase, the second frequency provided to the third electrode is shifted about 180° from the first phase, and the second frequency provided to the fourth electrode is shifted about 270° from the first phase. Ions travel along the axis and between the elongated electrodes. The second voltage component urges at least some of the ions traveling between the elongated electrodes into a generally spiral trajectory extending around the axis and the radii of the spiral trajectories for the selected ions is generally greater than the radius of the circular disk and the radii of the non-selected ions is generally less than the radius of the circular disk.

Another aspect of the claimed invention is a method of operating an ion filter for selecting ions. The filter has a plurality of elongated electrodes, and the ions have a secular frequency. The method comprises exciting each elongated electrode with a first voltage component, the first voltage component having a first amplitude and a first frequency; exciting each elongated electrode with a second voltage component, the second voltage component having a frequency substantially equal to a secular frequency of motion for the ion; and generating an electric field and rotating the electric field around the axis.

DETAILED DESCRIPTION

Figure 1:
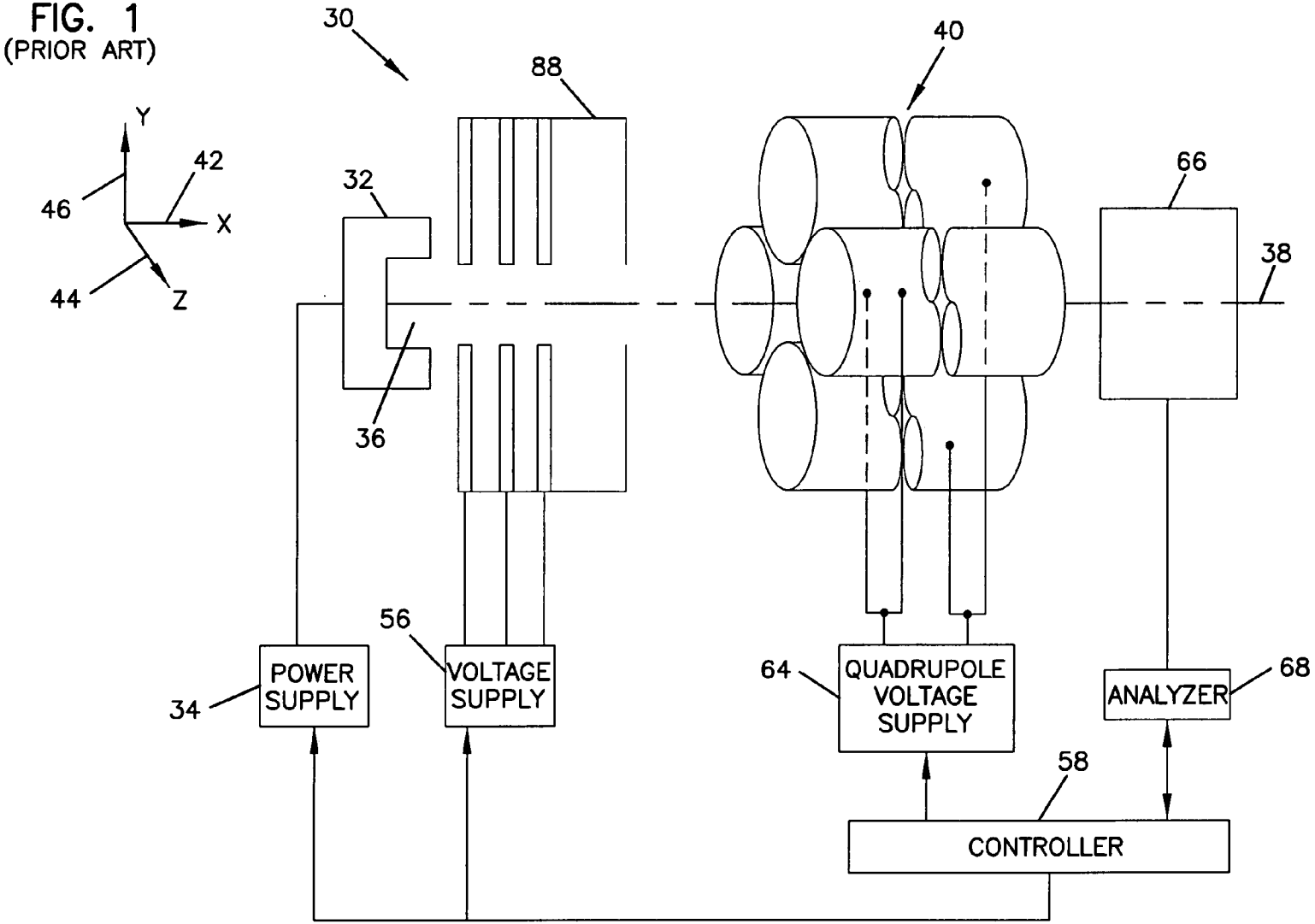
FIG. 1 (PRIOR ART)
FIG. 1 is a schematic and partial block diagram of a quadrupole mass filter spectrometer of a conventional design.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In the following, the AC quadrupole field produced in a quadrupole mass filter is sometimes called an RF field, produced by RF voltages applied to the rods, and the auxiliary AC rotational field produced in a quadrupole mass filter is called an AC field, produced by AC voltages applied to the rods. Although all RF voltages (fields) are AC voltages (fields), the converse is not necessarily true for low frequencies, according to convention. However, the value of frequency that distinguishes AC from RF is not well defined. The RF voltages and quadrupole fields described herein may in some embodiments have low enough frequencies that they would normally be called AC rather than RF, so it should be understood that the term "RF" as used herein includes AC voltages and fields of any frequency from less than 1 kHz to more than 100 MHz.

Figure 2:
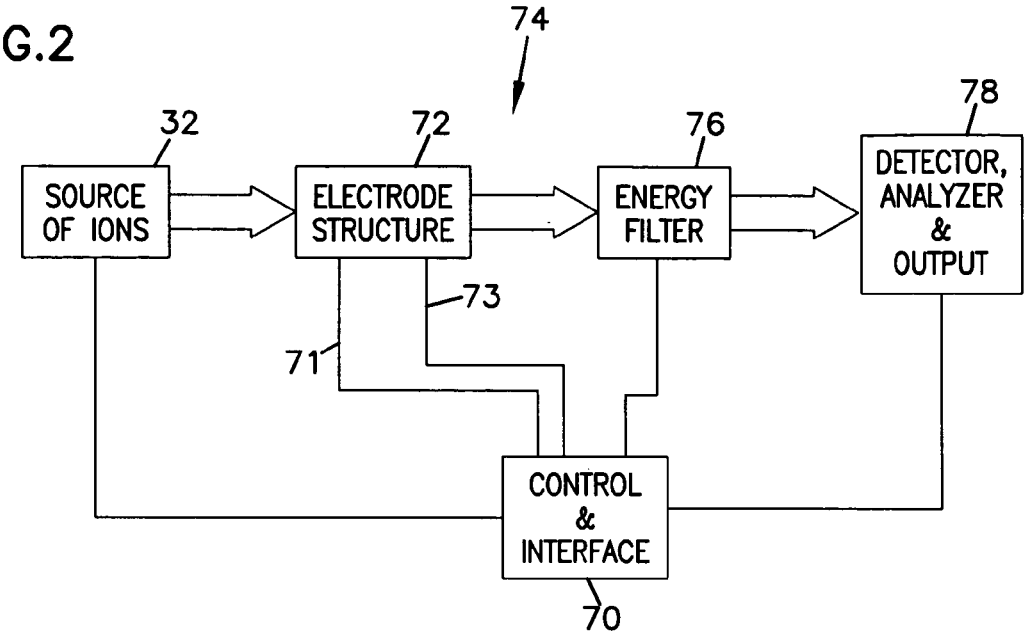
FIG. 2 is a schematic block diagram of a mass spectrometer for use with a mass filter.

FIG. 2 illustrates a possible embodiment of a mass filter having a rotating electric field in a mass spectrometer. (Although a mass spectrometer is described herein, a mass filter or ion guide device having a rotating electric field can be used in other instrumentation as well). The mass spectrometer 74 includes a source of ions 32 and a suitable control and interface structure 70 which may be implemented in any number of ways, including hardware, firmware and/or software, as would be apparent to one skilled in the art of designing mass spectrometers. Ions from ion source 32 enter an electrode structure 72 such as a quadrupole electrode assembly, where they are subjected to an electric field created by one or more voltages applied by control and interface 70. Control and interface 70 applies voltages to the electrodes to produce a rotating electric field between the electrodes so that selected ions will trace an arcuate, oval or circular path as they traverse the assembly to an output 74 of the electrode structure. In a possible embodiment, a first AC voltage 71 is applied to the electrode structure and a second AC voltage 73 is applied to the electrode structure having a frequency and amplitude significantly different from that of first AC voltage 71 to produce a rotating electric field between the electrodes, the rotating electric filed extending along substantially the entire length of the electrodes.

In another possible embodiment, second AC voltage 73 includes a number of components, one of which is typically 90 degrees out of phase with another, which may be used to produce a rotational electric field. In this embodiment, first AC voltage 71 is a conventional RF voltage, having little or no DC offset, and second AC voltage 73 is an auxiliary voltage having a frequency or multiple frequencies tuned to one or multiples of the secular frequencies of the ion or multiple ions of interest. In another embodiment, a DC voltage can be applied simultaneously to all of the elongated electrodes for control of the ion energy as it approached the elongated electrodes and enters the region around the axis that is defined by the elongated electrodes. The frequency of second AC voltage 73 may be half or less than that of first AC voltage 71. Mass selection is accomplished by selection of the appropriate frequency of second AC voltage 73. (In some modes of operation, ion mass selection can also be achieved by selecting the amplitude or frequency of first AC voltage 71. These modes may be especially useful for high-pass filtering in addition to mass selection with second AC voltage 73.)

Use of a second AC voltage 73 that produces a nonrotating dipole or quadrupole field at a secular or parametric frequency does not yield an effective RF-only quadrupole mass filter since the trajectories of the selected ions exhibit increasing radial amplitude as the ions traverse the length of electrode structure 72, resulting in large losses of selected ions. In the prior art, this nonrotating field scheme has been used as a mass notch filter to reject unwanted ions.

The rotating field created by second, auxiliary AC voltage 73 causes the selected ions excited by the field to execute trajectories in a band of radii from the central axis so that when they exit electrode structure 72 they have greater conversion of transverse energy to axial energy in the fringing field than the other, non-selected ions. Their greater energies allow them to penetrate and pass through an energy filter 76 which may be a conventional energy filter, that stops or bars other, non-selected ions from passing because they lack sufficient energy. The selected ions are then detected and analyzed in a detector and analyzer 78 for producing a suitable output to control and interface 70.

Figure 3:
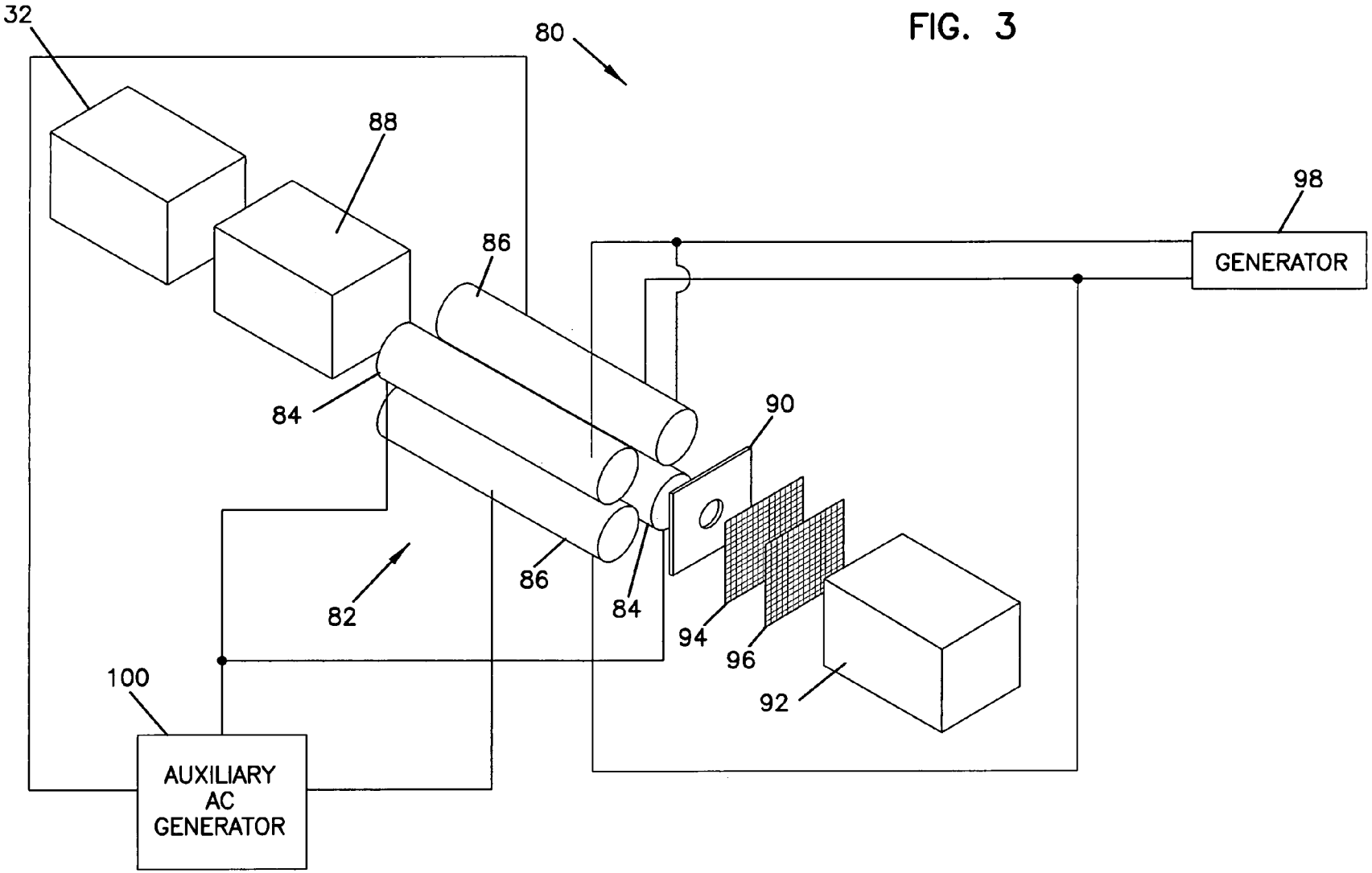
FIG. 3 is a schematic and block diagram of a quadrupole mass analyzer with a mass filter.

Referring to FIG. 3, a possible embodiment of a quadrupole mass analyzer 80 includes a plurality of longitudinally extending electrodes that generate AC electric fields within to excite ions from ion source 32. The electrodes are quadrupole electrodes 82 that include a first electrode pair 84 and a second electrode pair 86 positioned on opposite sides of an axis corresponding to the Z-axis. One advantage of a quadrupole mass analyzer using only AC fields, especially including a rotating electric field, is that it allows the dimensional and assembly requirements for quadrupole electrodes 82 and their related components to be relaxed while still achieving excellent resolution and transmission. A possible configuration of the individual electrodes is generally cylindrical with a generally circular cross-section or outer circumference, which is typically less expensive to manufacture than electrodes with hyperbolic cross-section. Rather than having to use a precision of tenths of a micron to several microns for the electrodes in order to achieve desired resolution and transmission, the electrode precision can be on the order of several thousandths of an inch.

In another embodiment, one pair or both pairs of quadrupole electrodes 84 and 86 are placed closer together or further apart relative to each other in order to superimpose an octopole electric field component onto the quadrupole field. The octopole component can be as much as 2% to 20% or more of the quadrupole field. This arrangement can narrow the mass peak width, thereby improving the resolution of the scan. Other methods can be used as well to make these improvements, such as changing the angles of the rods with respect to each other, or providing one rod pair 84 or 86 with a different radius relative to the other rod pair 86 or 84, respectively, to distort the quadrupole field.

Appropriate ion optics 88 may be positioned between ion source 32 and quadrupole electrodes 82 to focus or modify the ion trajectories before the ions are injected between the electrodes. Ion optics 88 can take any number of forms, and can be configured to have the ions in the most advantageous possible positions and trajectories before entering the quadrupole electric field.

Figure 5:
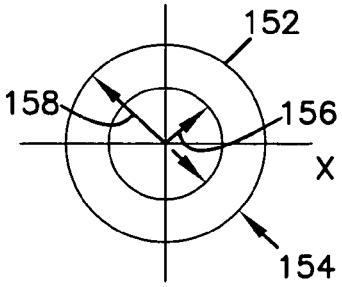
FIG. 5 is a graphical representation of a composite of traces of beam positions produced at the output of a quadrupole electrode assembly for a mass filter as illustrated in FIGS. 2 and 3.

An ion exit aperture 90 is defined in an aperture structure and is positioned adjacent the downstream end of quadrupole electrodes 82 for allowing passage of ions that are positioned within a given distance from the Z-axis, the central axis of the quadrupole electrodes. The diameter of the aperture is large enough to permit passage of the selected ions when those ions are approximately within the expected maximum outer diameter of the beam of excited ions, as described more fully below with respect to FIGS. 5–7. In a possible embodiment ion exit aperture 90 is coupled to ground, but may have a small DC bias. Ion exit aperture 90 may be a grid such as a conductive screen with or without a solid disk in the center, which forms an aperture arrangement. Ion exit aperture 90 can also be formed as part of the energy filter 95.

Energy filter 95 is positioned between exit aperture 90 and detector 92, and is shown in FIG. 3 as a pair of conductive elements or screens 94 and 96. Screens 94 and 96, with or without a center solid disk, are biased or charged with suitable voltages to produce the desired electric field to repel or create a barrier to or terminate ions that do not have a sufficiently high axial energy. Therefore, ions that pass aperture plate 90 and do not have sufficient energy in the axial direction to overcome the electric field of energy filter 95 are repelled back toward aperture plate 90 or neutralized on the disk. Those ions that were excited by the auxiliary AC rotating field to an axial energy sufficient to overcome the electric field of energy filter 95 pass through energy filter 95 and are detected in detector 92.

The threshold of energy filter 95 can be fixed or varied with the scanning parameters. For example, the threshold may be varied as a function of the mass of the ion in resonance, which is linked to the frequency of the auxiliary AC voltage. The relationship between mass and threshold energy may be determined empirically. Energy filter 95 may include a retarding field of, for example, from a tenth of a volt to many tens of volts. Energy filter 95 may also take any number of other configurations, such as multiple plates, multiple cylinders, and the like.

In an alternative embodiment, the energy filter 95 does not include the center disk. The ions excited by the rotating electric field generated second AC voltage 73 absorb more energy (potentially as much as two times more energy) than ions that are not excited by the rotating electric field, and some of the additional energy is translated into axial energy. This energy differential creates a more defined difference in the energy level of selected and non-selected ions, and the electric field applied to the conductive elements 94 and 96 can be tuned to correspond the axial energy of the non-selected ions and block those non-selected ions that pass through the aperture plate 90.

Quadrupole electrodes 82 are driven by a first voltage source in the form of a quadrupole power supply 98 programmed or otherwise controlled to produce first alternating current driving voltages $\pm V \sin \Omega t$ for the quadrupole electrodes, where V is the AC voltage magnitude and the voltage varies as a function of time t at frequency $\Omega$. The voltage magnitude V and the frequency $\Omega$ may vary in the range of about zero to over 5 kV, and about 200 kHz to about 10 MHz, respectively (Voltages and frequencies outside those ranges are possible and are within the scope of the invention). In a possible embodiment, there is little or no DC voltage, U, applied to the quadrupole electrodes.

Mass analyzer 80 also includes a second or auxiliary AC power supply 100 for applying a second AC voltage to the electrodes 82. The second AC voltage may be tuned to one of the secular frequencies $\omega_n$ of ion motion in the quadrupole electric field so that the selected ion will absorb energy and execute a trajectory at increased radius, which is the radial distance between the ion's trajectory or path and the axis, thereby leading to increased axial energy when exiting. In other embodiment, the second AC voltage may be tuned to the parametric resonance frequency of the selected ion or other multiples of the lowest secular frequency. The second voltage produces a rotating electric field in quadrupole electrodes 82, which in turn produces rotating or spiral paths in the ions. The total electric field within quadrupole electrodes 82 may be generated, for example, by superimposing the second AC voltage over the first AC voltage, as shown in FIG. 4.

The second or auxiliary AC voltage may take the form $A \cos \omega_0 t$. The amplitude A may be in the range of tenths of a volt to about 20 volts or more. In a possible embodiment, the frequency $\omega_0$ of the auxiliary AC voltage is equal to or less than half of the frequency of the RF voltage and may range from about 20 kHz to slightly less than about 500 kHz, or slightly less than half of the frequency of the RF voltage if the frequency of the RF is 1 MHz, a value often used. Selection of the frequency of the second AC voltage is based on the secular frequencies of the ion motion in a quadrupole electric field. In other embodiments, the frequency is selected based on the parametric resonance frequency or multiples of the lowest secular frequency of the selected ion.

Figure 4:
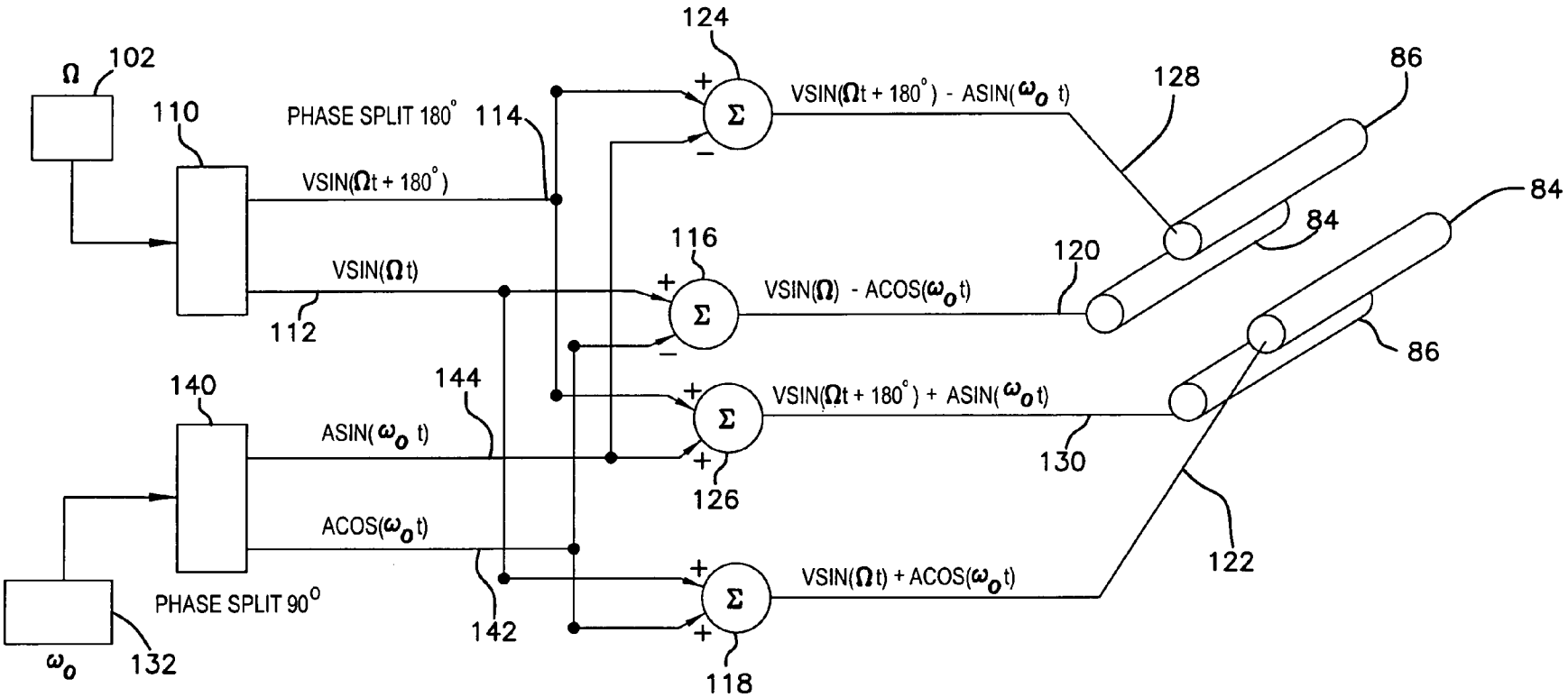
FIG. 4 is a schematic and block diagram of a control circuit for quadrupole electrode assembly for a mass filter as illustrated in FIGS. 2 and 3.

Referring to FIG. 4, a possible power supply or driving network for the quadrupole electrodes applies one voltage to the first pair of electrodes and an equal and opposite voltage to the other pair of electrodes. The auxiliary AC voltage, two components of which are about 90° out of phase with each other, is applied to the electrodes and may be phase locked with the RF voltage. In other embodiments, the auxiliary AC voltage may bear no fixed phase relationship with the RF voltage. No DC voltage is applied between the quadrupole electrode pairs. In another possible embodiment the DC voltage applied between the quadrupole electrode pairs may be nonzero but small.

An RF generator 102 produces a voltage having desired frequency Ω and amplitude V. The voltage is applied to a phase splitter 110 having a first output 112 producing a first sine voltage identical to the input and a second output 114 producing a second sine voltage identical to but about 180° out of phase from first output 112. The first sine voltage is applied to the non-inverting input of a first summing network 116 and to the non-inverting input of a second summing network 118. First summing network 116 has an output 120 coupled to one electrode in first pair of electrodes 84, and second summing network 118 has an output 122 coupled to the second electrode in first pair of electrodes 84.

The second sine voltage from second output 114 is applied to the non-inverting input of a third summing network 124 and also to the non-inverting input of a fourth summing network 126. Third summing network 124 includes an output 128 coupled to one of the electrodes in second pair of electrodes 86, and fourth summing network 126 includes an output 130 coupled to the other electrode in second pair electrodes 86.

An auxiliary AC generator 132 produces a voltage having the desired frequency $\omega_o$ and amplitude A. The AC voltage has an amplitude and frequency corresponding to the secular frequency of the ion of interest.

The AC voltage is applied to a 90° phase splitter 140, which has first and second outputs 142 and 144. The voltage at first output 142 is the original AC voltage and is proportional to cos $\omega_0 t$. The voltage at second output 144 has a phase shifted about 90° from the original AC voltage and is proportional to sin $\theta_0 t$. First output 142 is applied to the inverting input of first summing network 116 and to a non-inverting input of second summing network 118. Second output 144 is applied to the inverting input of third summing network 124 and a non-inverting input of fourth summing network 126. The summing networks then combine their input signals to produce output voltages for producing an electric field in the region bounded by quadrupole electrodes 82 in accordance with the RF voltage from RF generator 102 superimposed with the desired secular frequency voltage from auxiliary AC generator 132. The combination of the phase splitters and the summing networks apply the secondary voltage in such a way as to produce a rotating component of the electric field between the quadrupole electrode pairs 84 and 86. Other arrangements and circuits can be used for producing rotational electric fields between the quadrupole electrodes, and the control circuit shown in FIG. 4 is just one example of a suitable scheme.

The RF and AC generators can be adjusted to produce voltages at different levels and frequencies, as a function of the masses of the ions of interest. The generators are controlled by a processor or other controller pre-programmed so that the voltage amplitudes and frequencies can be adjusted as desired. One or more of the amplitude or frequency of either or both of the RF voltage and auxiliary AC voltage can be varied to scan the masses of interest, as will be apparent to those skilled in the art of quadrupole mass spectrometers.

Figure 9:
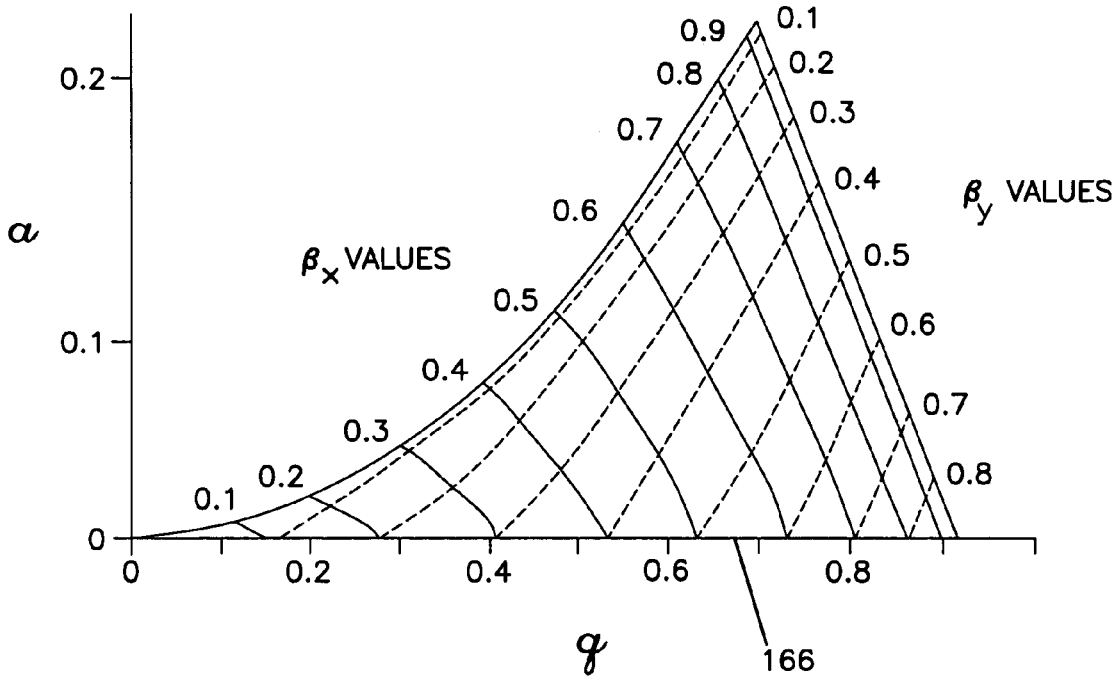
FIG. 9 is a graphical representation of a conventional stability diagram according to which quadrupole electrode assemblies can be operated.

The mass analyzer 80 described excites ions of a given mass, depending on the frequencies and amplitudes of the RF and frequency of the auxiliary voltages. One or more of these parameters can be varied to produce a scan of ion masses. For example, each ion has a fundamental secular frequency for a given point on the horizontal axis 166 of the stability diagram of FIG. 9. The desired mass can be selected for excitation, for example, by applying the auxiliary AC rotating field voltage at the appropriate frequency given the other parameters.

In one embodiment, the amplitude of the RF voltage is varied to produce the scan. The RF voltage frequency and the auxiliary AC voltage frequency remain fixed. In this embodiment, the amplitude of the AC voltage is fixed or varied with mass. In another embodiment, the amplitude of the RF voltage and the frequency of the auxiliary AC voltage are fixed and the frequency of the RF voltage is varied to produce the scan. The amplitude of the AC voltage can be fixed or varied with mass. In a further embodiment, the RF amplitude and frequency are fixed, the frequency of the auxiliary AC voltage is varied to produce the scan, and the AC voltage amplitude can be fixed or varied with mass. Varying these parameters can be carried out with an appropriate controller pre-programmed with appropriate data for selecting the parameters as a function of mass. The data may be developed empirically for any given system. The scans can also be carried out in other ways, known to those skilled in the art of quadrupole mass spectrometry. Furthermore, one mode of scanning can be combined with another mode to produce a suitable method of scanning. In another embodiment, the RF voltage amplitude and frequency can be set such as to cut off all ions with masses below a selected threshold, and this may be done in addition to mass filter actions created by the auxiliary rotating field.

The frequencies of the RF and auxiliary AC voltages can be linked or explicitly non-coherent. For example, they may be linked through a frequency divider (not shown) and they may be generated so that their phases are coherent with each other. For example, the frequency of the auxiliary AC voltage may be one-third or two-thirds that of the RF voltage with fixed phase relationships. Alternatively, they may be generated through separate frequency generators and controlled so as to produce voltages having different and unrelated phases.

Figure 6:
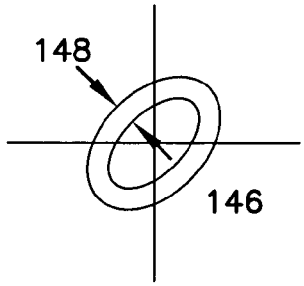
FIG. 6 is a graphical representation of beam position traces that may be produced at the output of a quadrupole electrode assembly as illustrated in FIGS. 3 and 4 during one phase of operation.
Figure 7:
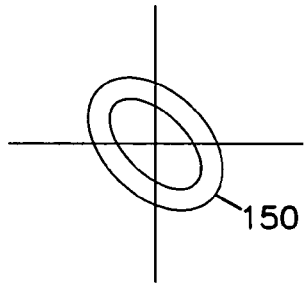
FIG. 7 is a graphical representation of beam position traces that may be produced at the output of a quadrupole electrode assembly as illustrated in FIGS. 3 and 4 during another phase of operation.
Figure 8:
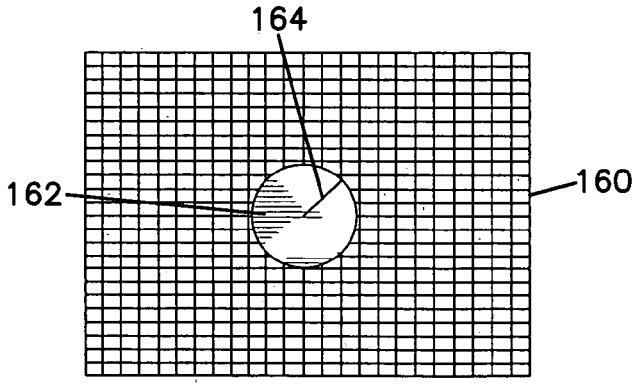
FIG. 8 is a schematic diagram of an energy filter showing a block.

The rotational electric field produced by the auxiliary AC voltage, when resonant with a secular or parametric frequency of motion, excites the selected ions of a given mass to have generally spiral trajectories at radii greater than when the selected ions are not excited by the rotating electric field and also greater than the radii of the non-selected ions. The rotational electric field causes the ions of the selected mass to follow an oval or partially circular trajectory approximately centered about the central or Z-axis, as depicted in FIGS. 6 and 7. As shown in FIG. 6, the ions of the selected mass will trace a path in the electric field and at the exit of the quadrupole electrodes 82 approximately within an oval 146 having a radial width 148. The orientation of the oval depends on the phase of the auxiliary AC voltage at any given time, and is shown in FIG. 6 as having a major axis symmetric with an angle at about 45 degrees to the x- and y-directions. At a point later in time, ions may be found within the oval 150 (FIG. 7). The width of the oval will vary as a function of the ion energies and their initial conditions entering the quadrupole field. Over a complete cycle of the auxiliary voltage, the composite of the oval ion distribution will appear as a near circular ion distribution 152 (FIG. 5), where the inside diameter of the circle represents the approximate length of the minor axis of oval 146 or 150 and the outside diameter represents the maximum length of the major axis of the oval or ellipse, and hence the ions will travel along a generally spiral trajectory. Consequently, the radial distribution of the ions will produce a radial width 154 that is greater than radial width 148. The distribution of ions shown in FIG. 5 indicates that the majority if not all of the ions of interest will be found at a distance $r_{min}$ 156 from the central axis but less than a distance $r_{max}$ 158 from the central axis. Because most if not all ions of interest will be outside the radius $r_{min}$ 156 one of the conductive elements 160 (FIG. 8) in the energy filter can include a solid, conductive block 162 to block all ions spaced less than a distance 164 from the central axis of the electrodes. Use of an energy filter 95 with a block reduces noise in the mass analyzer and helps to increase the signal-to-noise ratio, S/N.

The various embodiments described above are provided by way of illustration only and should not be construed to limit the invention. Those skilled in the art will readily recognize various modifications and changes that may be made to the present invention without following the example embodiments and applications illustrated and described herein, and without departing from the true spirit and scope of the present invention, which is set forth in the following claims.

I claim:

1. A method of operating an ion filter for selecting ions, the filter having a plurality of elongated electrodes positioned around an axis, the ions having a secular frequency, the method comprising:

exciting each elongated electrode with a first voltage component, the first voltage component having a first amplitude and a first frequency;

exciting each elongated electrode with a second voltage component, the second voltage component having a frequency substantially equal to a secular frequency of motion for the ion; and generating an electric field and rotating the electric field around the axis.

2. The method of claim 1 herein the act of exciting each electrode with a second voltage component includes:

exciting a first elongated electrode with a second voltage component having a first phase;

exciting a second elongated electrode with a second voltage component having a second phase shifted about 90° from the first phase;

exciting a third elongated electrode with a second voltage component having a third phase shifted about 180° from the first phase; and exciting a fourth elongated electrode with a second voltage component having a fourth phase shifted about 270' from the first phase.

3. The method of claim 1 further comprising injecting ions into the electric field; and moving the ions according to a generally spiral trajectory defined around the axis and along the length of the axis.

4. The method of claim 1 wherein exciting each electrode with a first voltage component includes scanning an amplitude of the first voltage component through a range of values, the range of values corresponding to a predetermined range of mass-to-charge ratios.

5. The method of claim 4 wherein exciting each electrode with a second voltage component includes scanning an amplitude of the second voltage component through a range of values.

6. The method of claim 1 wherein exciting each electrode with a first voltage component includes scanning a frequency of the first voltage component through a range of values, the range of values corresponding to a predetermined range of mass-to-charge ratios.

7. The method of claim 1 wherein exciting each electrode with a second voltage component includes scanning a frequency of the second voltage component through a range of values, the range of values corresponding to a predetermined range mass-to-charge ratios.

8. The method of claim 7 wherein exciting each electrode with a first voltage component includes scanning an amplitude of the first voltage component through a range of values.

9. The method of claim 1 wherein exciting each electrode with a first voltage component includes scanning a frequency of the first voltage component through a range of values, the range of values corresponding to a predetermined range of mass-to-charge ratios.

10. An apparatus for filtering non-selected ions and passing selected ions according to a mass-to-charge ratio, the selected ions having a secular frequency, the apparatus comprising:

a plurality of elongated electrodes, the elongated electrodes positioned substantially parallel to an axis; and a power supply in electrical communication with the plurality of elongated electrodes, the power supply generating two voltage components, the first voltage component having a first amplitude and a first frequency, the second voltage component having a second amplitude and a second frequency;

wherein the second frequency is substantially equal to a secular frequency of motion for the selected ion and the second voltage component provided to each elongated electrode has a different phase.

11. The apparatus of claim 10 wherein ions travel between the elongated electrodes and the second voltage component excites at least some of the ions traveling between the elongated electrodes and urges them into a generally spiral trajectory extending around the axis.

12. The apparatus of claim 10 wherein the selected ions absorb more energy from the electric field generated by the second voltage component than the non-selected ions.

13. The apparatus of claim 12 further comprising an energy filter positioned down stream from the plurality of elongated electrodes, the energy filter comprising an electric field, the electric field repelling substantially all of the non-selected ions that reach the electric field.

14. The apparatus of claim 13 further comprising a circular disk positioned downstream from the elongated electrodes, the circular disk being substantially orthogonal to and centered on the axis, the circular disk having a radius less than the minimum radius of the spiral trajectory of the selected ions.

15. The apparatus of claim 14 further comprising an aperture structure positioned between the plurality of elongated electrodes and the energy filter, the aperture structure defining an exit aperture centered on the axis, the exit aperture having circular cross section and a radius greater than the maximum radius of the spiral path of the selected ion.

16. The apparatus of claim 10 further comprising a control circuit, the control circuit controlling the power supply to scan, through a range of at least one parameter of the first and second voltage components, the mass-to-charge ratio for the selected ions.

17. The apparatus of claim 16 wherein the at least one parameter is selected from the group consisting of: the first frequency of the first voltage component, the first amplitude of the first voltage component, the second frequency of the second voltage component, and the second amplitude of the second voltage component.

18. The apparatus of claim 10 wherein the plurality of elongated electrodes includes four electrodes forming a quadrupole filter.

19. The apparatus of claim 18 wherein the power supply is arranged to:

apply the second voltage component having a first phase to a first elongated electrode;

apply the second voltage component to a second elongated electrode, the second voltage component having a second phase shifted about 90° from the first phase;

apply the second voltage component to a third elongated electrode, the second voltage component having a second phase shifted about 180° from the first phase; and apply the second voltage component to a fourth elongated electrode, the second voltage component having a second phase shifted about 270° from the first phase.

20. The apparatus of claim 19 wherein the frequency of the second voltage component is substantially equal to the lowest secular frequency of motion for the selected ion.

21. The apparatus of claim 19 wherein the frequency of the second voltage component is substantially equal to the parametric resonance frequency of the selected ion.

22. The apparatus of claim 19 wherein the first voltage component of each voltage has a first amplitude and the second voltage component of each voltage has a second amplitude less than the first amplitude.

23. The apparatus of claim 18 wherein the power supply generates the first and second voltage components without a DC offset.

24. An apparatus for filtering non-selected ions and passing selected ions according to a mass-to-charge ratio, the selected ions having a secular frequency, the apparatus comprising:

a plurality of elongated electrodes, the elongated electrodes positioned substantially parallel to an axis;

a power supply in electrical communication with the plurality of elongated electrodes, the power supply generating two voltage components, the first voltage component having a first amplitude and a first frequency, the second voltage component having a second amplitude and a second frequency, wherein the second frequency is substantially equal to a secular frequency of motion for the selected ion and the second voltage component provided to each elongated electrode has a different phase;

an ion source positioned upstream from the elongated electrodes; and an ion detector positioned downstream from the plurality of elongated electrodes.

25. An apparatus for filtering non-selected ions and passing selected ions according to a mass-to-charge ratio, the selected ions having a secular frequency, the apparatus comprising:

four elongated electrodes, the elongated electrodes positioned substantially parallel to and equidistant from an axis;

a circular disk positioned downstream from the elongated electrodes, the circular disk being substantially orthogonal to and centered on the axis; and a power supply in electrical communication with the four elongated electrodes, the power supply generating two voltage components, the first voltage component having a first amplitude and a first frequency, the second voltage component having a second amplitude and a second frequency;

wherein the second frequency is substantially equal to a secular frequency of motion for the ion and the second voltage component provided to the first electrode has a first phase, the second voltage component provided to the second electrode is shifted about 90° from the first phase, the second voltage component provided to the third electrode is shifted about 180° from the first phase, and the second voltage component provided to the fourth electrode is shifted about 270° from the first phase;

wherein ions travel along the axis and between the elongated electrodes and the second voltage component urges at least some of the ions traveling between the elongated electrodes into a generally spiral trajectory extending around the axis and the radii of the spiral trajectories for the selected ions is generally greater than the radius of the circular disk and the radii of the non-selected ions is generally less than the radius of the circular disk.

* * * * *